US006246364B1

(12) United States Patent
Rao et al.

(10) Patent No.: US 6,246,364 B1
(45) Date of Patent: Jun. 12, 2001

(54) LIGHT-WEIGHT MODULAR LOW-LEVEL RECONFIGURABLE BEAMFORMER FOR ARRAY ANTENNAS

(75) Inventors: Sudhakar K. Rao, Torrance; Shih-Chang Wu, Alhambra; Jon J. Gulick, Hawthorne, all of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/336,224

(22) Filed: Jun. 18, 1999

(51) Int. Cl.[7] ..... H01Q 3/24; H01Q 3/26

(52) U.S. Cl. ..... 342/368; 342/374

(58) Field of Search ..... 342/368, 372, 342/373, 374

(56) References Cited

U.S. PATENT DOCUMENTS 4,814,775 * 3/1989 Raab et al. ..... 342/373

* cited by examiner

*Primary Examiner*—Daniel T. Pihulic
(74) *Attorney, Agent, or Firm*—Gates & Cooper LLP

(57) ABSTRACT

A method and apparatus for forming satellite transmission beams are disclosed. A beamforming network in accordance with the present invention comprises an array of antennas and primary and secondary dividing networks. The array of antennas comprises at least a first subarray having a first number of elements and a second subarray having a second number of elements. The primary dividing network divides a beam signal into a plurality of panel signals, wherein a number of panel signals is substantially equal to a number of subarrays. The secondary dividing network divides a first panel signal into a first plurality of element signals substantially equal in number to the first number of elements and for dividing a second panel signal into a second plurality of element signals substantially equal in number to the second number of elements.

15 Claims, 7 Drawing Sheets

LIGHT-WEIGHT MODULAR LOW-LEVEL RECONFIGURABLE BEAMFORMER FOR ARRAY ANTENNAS

CROSS-REFERENCE TO RELATED APPLICATIONS

This application is related to application Ser. No. 09/092,511, now U.S. Pat. No. 6,141,786 entitled "RECONFIGURABLE MULTIPLE BEAM SATELLITE PHASED ARRAY ANTENNA," filed Jun. 4, 1998, by Sudhakar K. Rao, et al.;

application Ser. No. 09/222,200, entitled "RECONFIGURABLE MULTIBEAM COMMUNICATIONS SATELLITE HAVING FREQUENCY CHANNELIZATION," filed Dec. 23, 1998, by G. Adams, et al.; and application Ser. No. 09/286,379, now U.S. Pat. No. 6,137,450 entitled "DUAL-LINEARLY POLARIZED MULTIMODE RECTANGULAR HORN FOR ARRAY ANTENNAS," filed Apr. 5, 1999, by A. Bhattacharyya et al.;

all of which applications are hereby incorporated by reference herein.

BACKGROUND OF THE INVENTION

1. Field of the Invention

This invention relates in general to array antennas, and, in particular, to a lightweight modular low-level reconfigurable beamformer for array antennas.

2. Description of Related Art

Communications satellites are in widespread use. The communications satellites are used to deliver television and communications signals around the earth for public, private, and military uses.

The primary design constraints for communications satellites are antenna beam coverage and radiated Radio Frequency (RF) power. These two design constraints are typically thought of to be paramount in the satellite design because they determine which customers on the earth will be able to receive satellite communications service. Further, the satellite weight becomes a factor, because launch vehicles are limited as to how much weight can be placed into orbit.

Many satellites operate over fixed coverage regions and employ polarization techniques, e.g., horizontal and vertical polarized signals, to increase the number of signals that the satellite can transmit and receive. These polarization techniques use overlapping reflectors where the reflector surfaces are independently shaped to produce substantially congruent coverage regions for the polarized signals. This approach is limited because the coverage regions are fixed and cannot be changed on-orbit, and the cross-polarization isolation for wider coverage regions is limited to the point that many satellite signal transmission requirements cannot increase their coverage regions.

Many satellite systems would be more efficient if they contained antennas with high directivity of the antenna beam and had the ability to have the coverage region be electronically configured on-orbit to different desired beam patterns. These objectives are typically met using a phased array antenna system. However, phased array antennas carry with them the problems of large signal losses between the power amplifiers and the beam ports, because of the beamforming network interconnections and long transmission lines.

Further, the beamforming network is heavy, difficult to integrate and test, and is difficult to repair or replace without large time and labor costs.

There is therefore a need in the art for a beamformer that can reduce the signal losses of a phased array antenna system. There is also a need in the art for a beamformer that is easier to integrate and test. There is also a need in the art for a beamformer that to provide more complete utilization of space assets without dramatically increasing the cost of manufacturing and operating a satellite.

SUMMARY OF THE INVENTION

To overcome the limitations in the prior art described above, and to overcome other limitations that will become apparent upon reading and understanding the present specification, the present invention discloses a method and apparatus for forming beams with antenna arrays. The modularity of the present invention is achieved by dividing the large array into a discrete number of smaller subarrays or panels. The beamforming network (BFN) is simplified by splitting the BFN into a primary dividing network and a secondary dividing network. Each beam has an independent beamforming network, the number of BFNs being equal to the number of beams.

A beamforming network in accordance with the present invention comprises an array of antennas and primary and secondary dividing networks. The array of antennas comprises at least a first subarray having a first number of elements and a second subarray having a second number of elements. The primary dividing network divides a beam signal into a plurality of panel signals, wherein a number of panel signals is substantially equal to a number of subarrays. The secondary dividing network divides a first panel signal into a first plurality of element signals substantially equal in number to the first number of elements and for dividing a second panel signal into a second plurality of element signals substantially equal in number to the second number of elements.

An object of the present invention is to provide a modular beamformer that can reduce the power dissipation and signal losses of a phased array antenna system. Another object of the present invention is to provide a beamformer that is easier to integrate and test. Another object of the present invention is to provide a beamformer that provides more complete utilization of space assets without dramatically increasing the cost of manufacturing and operating a satellite.

BRIEF DESCRIPTION OF THE DRAWINGS

Referring now to the drawings in which like reference numbers represent corresponding parts throughout.

DETAILED DESCRIPTION OF THE PREFERRED EMBODIMENT

Figure 1:
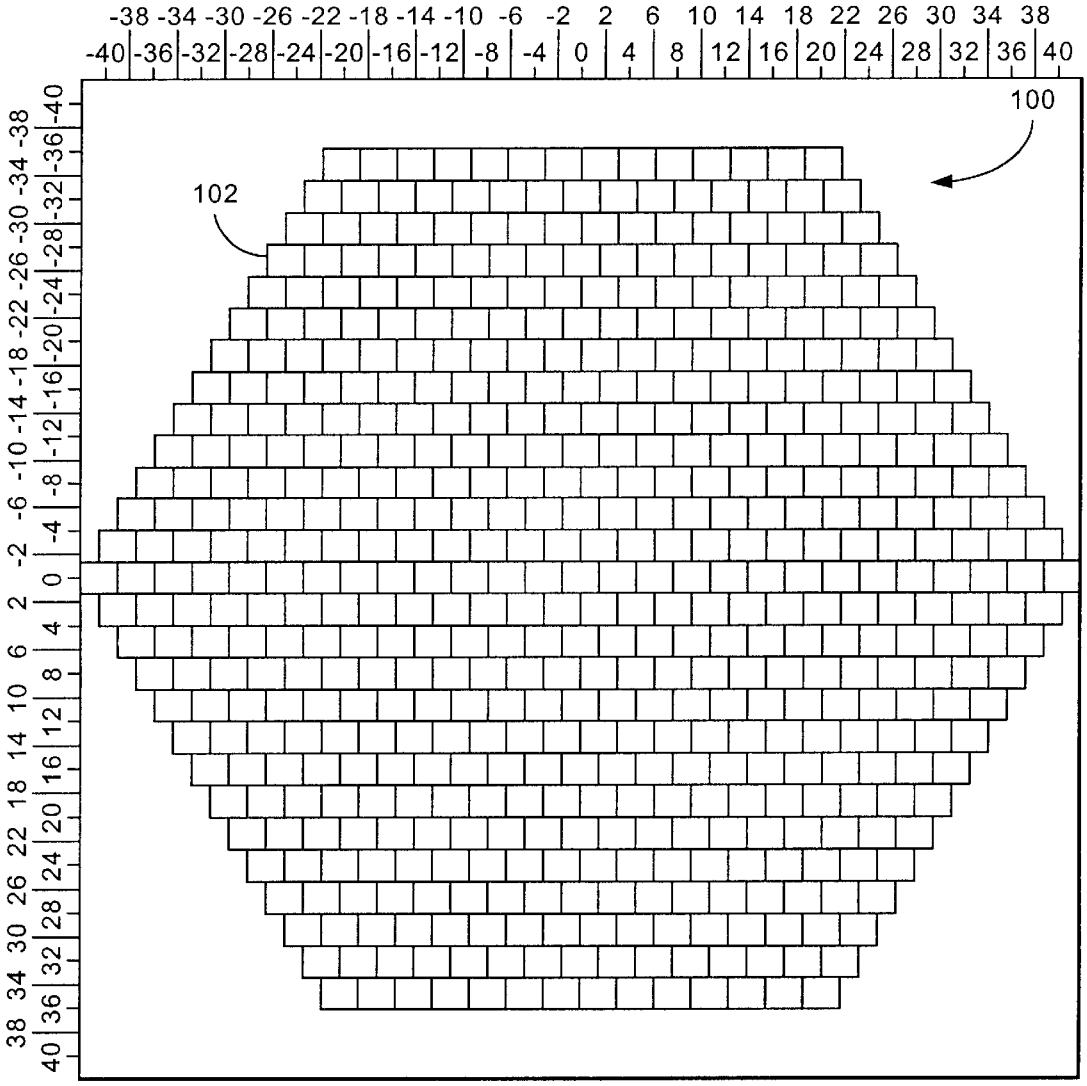
FIG. 1 PRIOR ART
FIG. 1 illustrates a typical antenna array of the prior art.

In the following description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

Overview

Many satellites operate over fixed coverage regions and employ polarization techniques, e.g., horizontal and vertical linearly polarized signals or right-hand and left-hand circularly polarized signals, to increase the number of signals that the satellite can transmit and receive. These polarization techniques use either overlapping reflectors where the reflector surfaces are independently shaped to produce substantially congruent coverage regions for the linearly polarized signals, or solid reflectors with dual-circular feeds for circularly polarized signals. This approach is limited because the coverage regions are fixed and cannot be changed on-orbit, and the cross-polarization isolation for wider coverage regions is limited to the point that many satellite signal transmission requirements cannot increase their coverage regions.

Many satellite systems would be more efficient with antennas having high directivity of the antenna beam and having the ability to reconfigure the coverage region on-orbit to different desired beam patterns. These objectives are typically met using a phased array antenna system. However, phased array antennas carry with them the problems of large signal losses between the power amplifiers and the beam ports, because of the beamforming network interconnections and long transmission lines. Further, the beamforming network is heavy, difficult to integrate and test, and is difficult to repair or replace without large time and labor costs.

The present invention describes a lightweight low-power-level beamformer capable of producing several reconfigurable beams using an antenna array. The beamformer of the present invention is capable of changing the beam positions and/or beam shapes of satellite payloads on-orbit.

A modular approach is incorporated in the reconfigurable beamformer of the present invention to simplify the design, manufacture, test and integration of the reconfigurable beamformer. The modularity of the present invention's design is achieved by dividing the antenna array into a number of discrete panels or subarrays and using localized beamformer networks to form the antenna beam patterns. This allows for reductions in mass and size of the overall system, and reduces the power dissipation in the pre-amplifier stage of the payload.

The present invention can be used with many satellite payloads and is not limited by frequency band. For example, fixed and broadcast satellite services at Ku-band and C-band and personal communication satellites at Ka-band can all benefit from implementation of the present invention. Further, the present invention is applicable to direct radiating array antennas that produce multiple reconfigurable shaped beams or spot beams for specific applications.

Prior Art Systems

FIG. 1 illustrates a typical antenna array of the prior art. Antenna array 100 contains 547 radiating elements arranged in a hexagonal grid pattern. The pattern of antenna array 100 contains 27 rows of offset horns. A typical horn 102 is a high-efficiency, multi-mode horn with an aspect ratio of 1:0.866 to fit in the hexagonal grid layout of the array. The spacing between horns (the inter-element spacing) is approximately 3.1 inches. Antenna array 100 can produce up to eight reconfigurable shaped transmission beams for each polarization, e.g., eight beams for a horizontal polarization, and eight additional beams for a vertical polarization.

Figure 2:
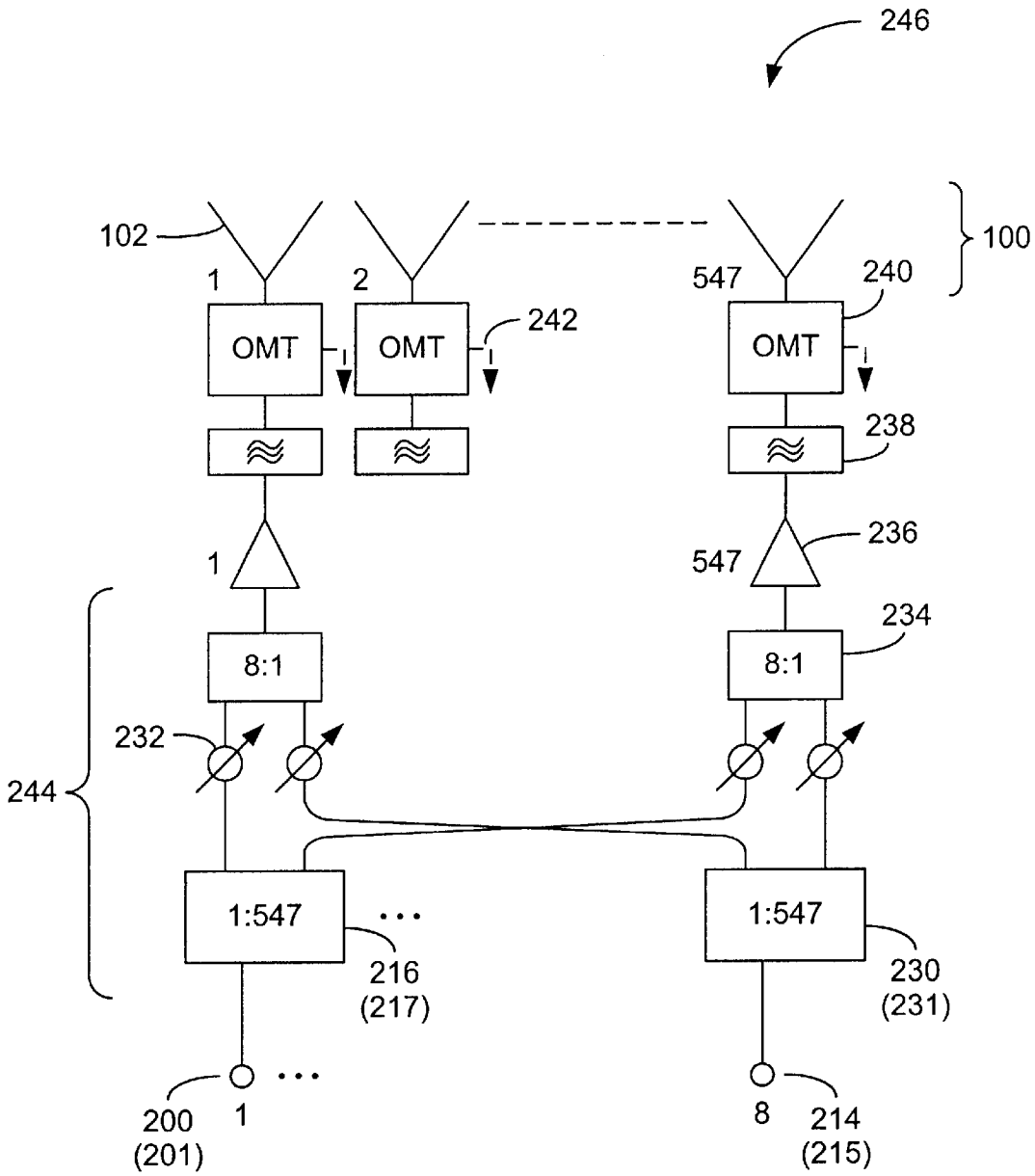
FIG. 2 PRIOR ART
FIG. 2 illustrates a block diagram of the reconfigurable transmit payload using a prior art beamformer.

FIG. 2 illustrates a block diagram of the reconfigurable transmit payload using a prior art beamformer.

Each input signal 200–215 comprises microwave signals to be transmitted by antenna array 100 as a beam. For example, input signal 200 will comprise one beam to be transmitted by antenna array 100, while input signal 214 comprises a separate beam to be transmitted by antenna array 100. There can be a larger or smaller number of beams, and therefore, a larger or smaller number of input signals 200–215. Eight input signals 200–214 are shown for illustrative purposes only. Further, only one polarization for input signals 200–214 are shown; there are corresponding input signals 201–215 for the opposite polarization.

Divider networks 216–231 divide each input signal 200–215 into signals that will be fed to each antenna horn 102 in antenna array 100. As shown in FIG. 2, divider network 216 divides input signal 200 into 547 signals. Each of these signals is fed through variable phase shifters 232 and the eight independent signals for each polarization are combined through the combining networks 234, to an amplifier 236. The amplifier 236 amplifies the signal, which then passes through a filter 238 and an Ortho-Mode Transducer (OMT) 240, before being radiated by antenna array 100.

There are 547 OMTs 240, one for each horn 102 in antenna array 100. The OMT 240 combines the dual linear polarizations of input signals 200–215 with sufficient isolation between the input signals 200–215. Input 242 on OMT 240 illustrates the opposite polarization signal for input signals 201–215.

The amplifiers 236 are typically Solid-State Power Amplifiers (SSPAs). There are two independent sets of amplifiers 236, one set of 547 amplifiers 236 for each polarization. The amplifiers 236 are sized in terms of Radio Frequency (RF) power output to produce tapered illumination across the antenna array 100, which reduces antenna array 100 beam sidelobe power levels.

The beamforming network (BFN) 244, which comprises the dividing networks 216–231, phase shifters 232, and combining networks 234, must also produce a substantially identical tapered distribution of signal power levels to the amplifiers 236 to maximize the amplifier efficiency. The system 246 requires a large area for amplifier 236 placement, and large line lengths to feed signals across BFN 244, e.g., input signal 200 through divider network 216 to the combining network 234 associated with the $547^{th}$ horn 102 of antenna array 100 becomes quite long. Further, the power required to drive a signal from input signal 100 to all 547 horns 102 in antenna array 100 becomes large, which reduces the power available to power the amplifiers 236 and increases the power dissipation. This, in turn, lowers the Effective Isotropic Radiated Power (EIRP) that antenna array 100 can effectively deliver to various coverage beams.

Subarray Configuration

Figure 3:
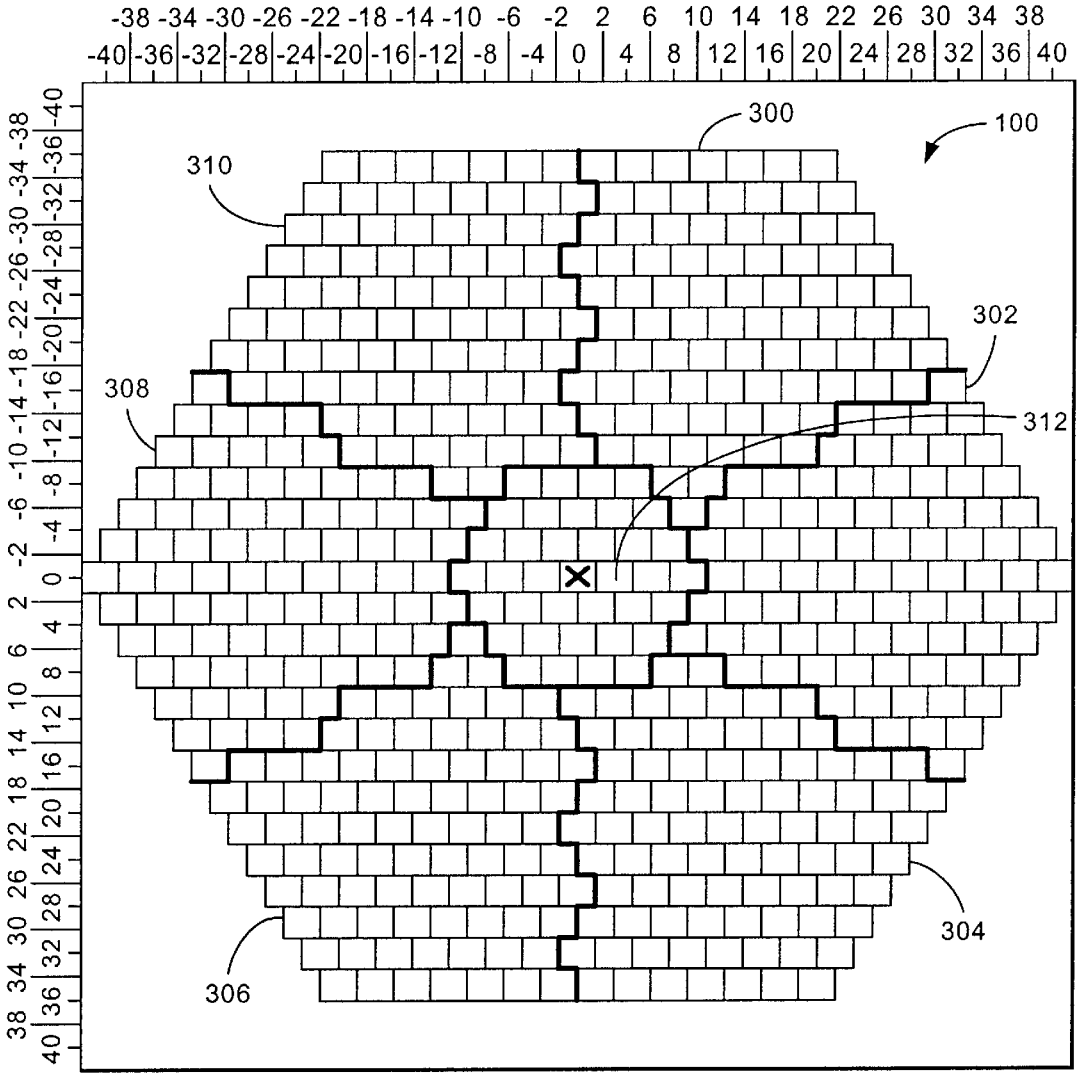
FIG. 3 illustrates the present invention's division of the antenna array into subarrays.

FIG. 3 illustrates the present invention's division of the antenna array into subarrays.

FIG. 3 shows that antenna array 100 can be divided into seven separate subarrays 300–312. Although shown as seven subarrays, the number of subarrays can be greater or fewer, or can be reconfigured as desired. Subarrays 300–310 each contain 85 horns 102, while subarray 312 contains 37 horns 102. Subarrays 300–310 are substantially identical, and rotated 60 degrees with respect to adjacent subarrays 300–310. Although shown as having the same number of horns 102, subarrays 300–310 can have different numbers of horns 102. Further, subarrays 300–312 can all have the same number of horns 102 if desired.

Block Diagram

Figure 4:
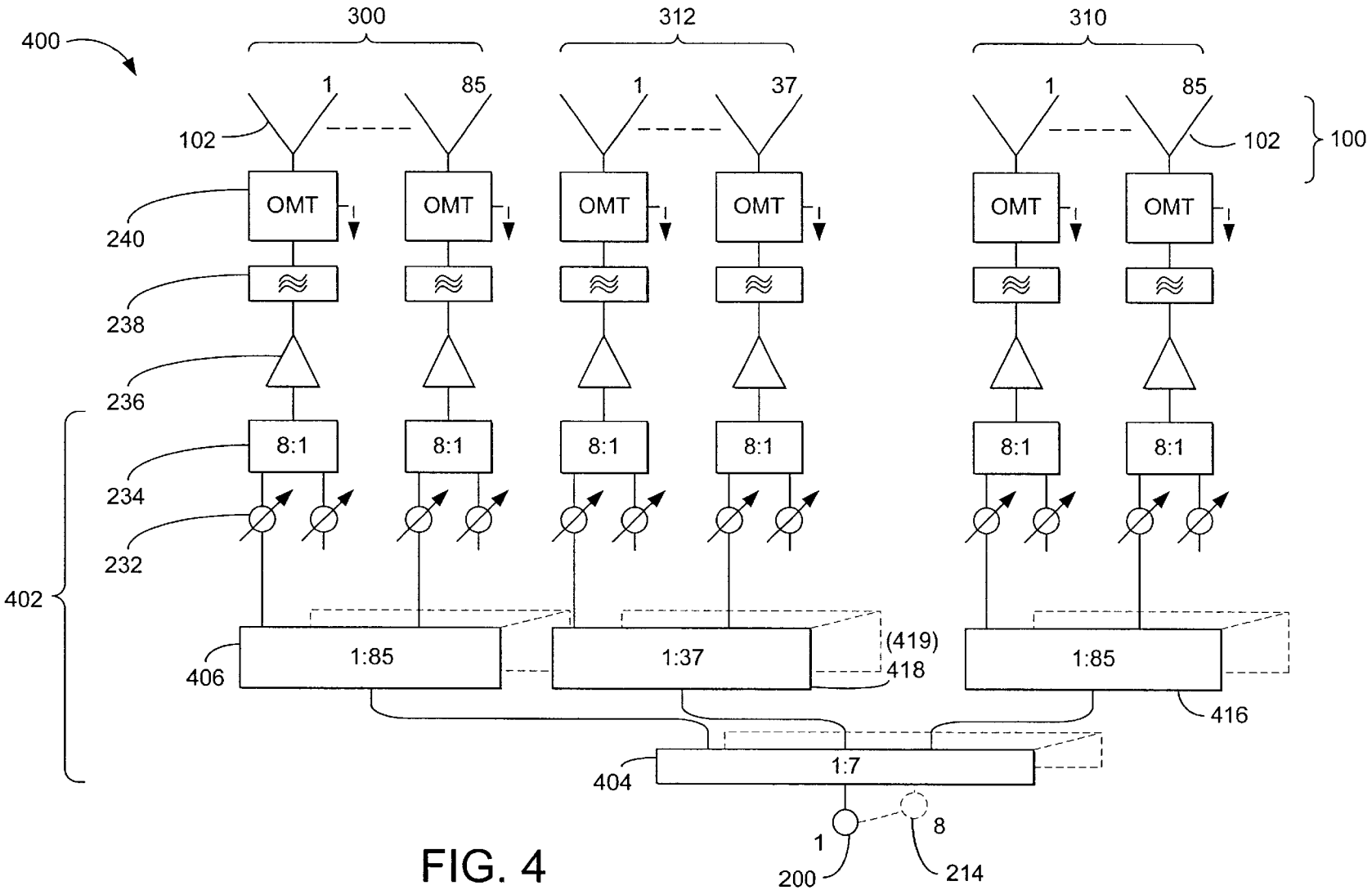
FIG. 4 is a block diagram of the beamformer of the present invention.

FIG. 4 is a block diagram of the beamformer of the present invention.

Instead of a single 1:547 dividing network 216, the present invention uses two stages of division coupled with a division of the antenna array 100 into discrete subarrays to achieve the modularity of the reconfigurable system 400. The BFN 402 now services each subarray 300–312 with a primary dividing network 404 and a dedicated secondary dividing network 406–419 for each subarray 300–312, respectively. For example, secondary dividing network 406 is dedicated to subarray 300, while secondary dividing network 418 is dedicated to subarray 312.

The dividing network 216 is thus replaced with a partitioned network, comprising six identical secondary dividing networks 406–416 of 1:85 signals apiece, and a single 1:37 secondary dividing network 418 for each polarization. The number of signals that each secondary dividing network 406–419 controls is substantially equal to the number of horns 102 resident in the corresponding subarray 300–312, e.g., secondary dividing network 406 can control 85 signals, and there are 85 horns 102 in subarray 300, while secondary dividing network 418 controls 37 signals, and there are 37 horns 102 in subarray 312. The number of signals that individual secondary dividing networks 406–419 control are not limited to the number of horns 102 in the corresponding subarray 300–312. Secondary dividing networks 406–419 can control a greater number of signals or a lesser number of signals if so desired.

Primary dividing network 404 is shown as a 1:7 network. The number of signals that are generated by primary dividing network 404 is typically substantially equal to the number of subarrays 300–312 that are present in antenna array 100. However, the primary dividing network 404 can generate a greater or lesser number of signals, as desired, to allow for redundant signals within primary dividing network 404, to allow for switching of signals within primary dividing network 404, or for other reasons. The dividing networks 404, because of their smaller divisive requirements as opposed to the 1:547 dividing network 216, can be realized in a low-loss stripline medium using a lower dielectric constant, or using a waveguide medium. The dividing network 216 cannot be manufactured in such a medium in a cost or power efficient manner. Further, six of the seven secondary dividing networks 406–416 are all identical within each beam, and therefore can be made in a modular fashion for interchangeability, ease of test and integration, and lower costs. The modular nature of the secondary dividing networks 406–419 also reduces the volume required to build BFN 402 of the present invention as compared to the BFN 244 shown in FIG. 2. Furthermore, all the primary dividing networks 404 and secondary dividing networks 406–419 are identical for all the beams.

Each secondary dividing network 406–419 corresponds to a single reconfigurable shaped beam generated by antenna array 100. Although shown with eight different reconfigurable beams per polarization for ease of understanding, a greater or lesser number of beams, and thus, a greater or lesser number of subarrays 300–312, are possible with the present invention.

Figure 5:
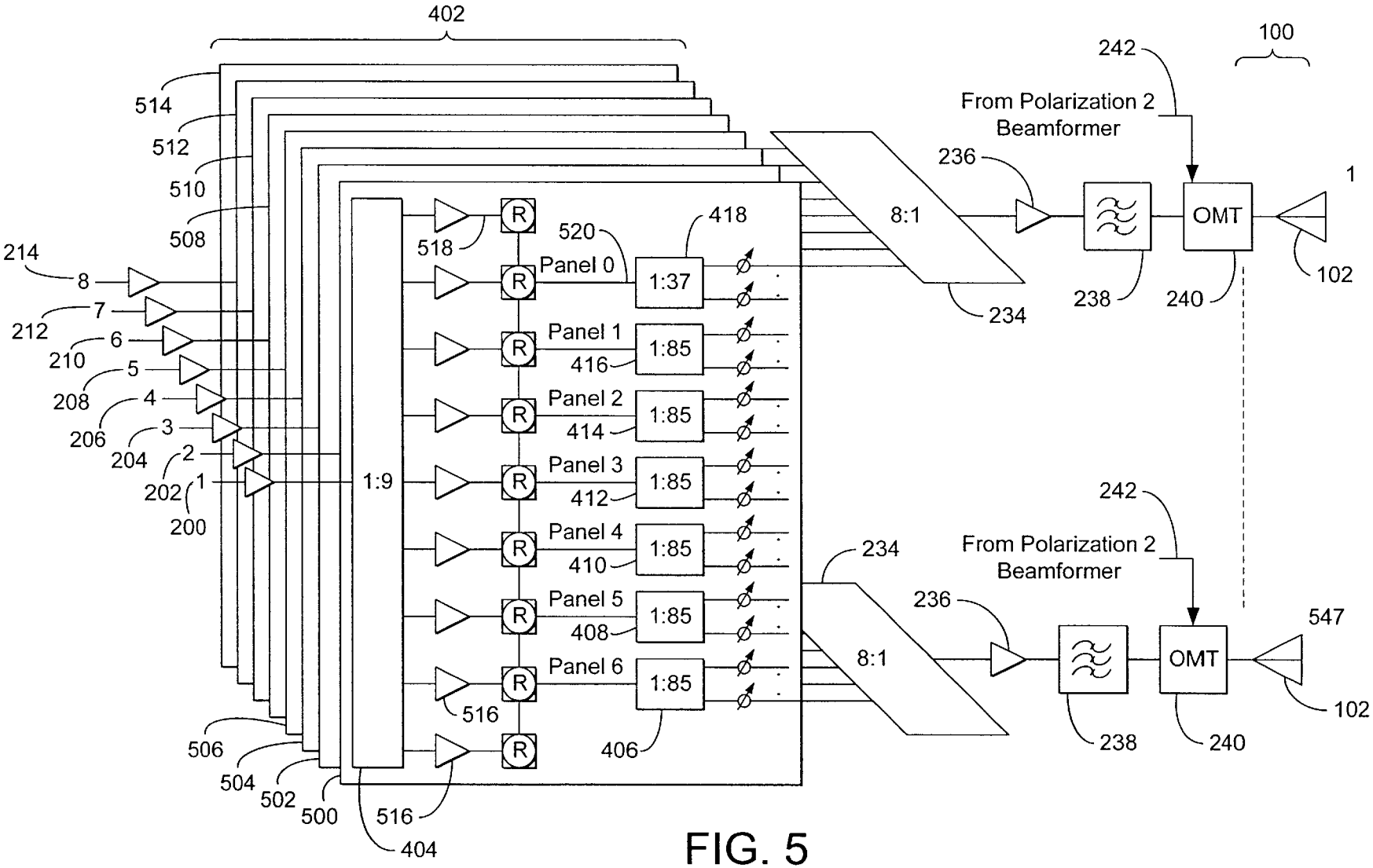
FIG. 5 illustrates the modular design of the present invention.

FIG. 5 illustrates the modular design of the present invention. As shown in FIG. 5, input signals 200–214 are fed into modules 500–514 respectively, e.g., input signal 200 is fed into module 500, input signal 202 is fed into module 502, etc. Each module 500–514 contains the BFN 402 for each input signal 202–214.

Since modules 500–514 are identical, the modules 500–514 can be mass produced for ease of manufacture and lower costs. Further, should one module 500 fail, only that module 500 needs to be replaced, as opposed to the 1:547 BFN 244 described in FIG. 2. The compact nature of modules 500–514 also allows the modules to be placed in a smaller enclosure to decrease the size required to perform the beamforming functions required.

Primary dividing network 404 is shown in FIG. 5 as a 1:9 dividing network instead of the 1:7 network shown in FIG. 4. This is done to allow redundant pre-amplifiers 516 to be installed on each module 500–514, which significantly reduces the chance of catastrophic failure of the BFN 402.

The compact nature of modules 500–514 also allows the line lengths within BFN 402 to be shorter, e.g., line lengths 518 and 520 are now much shorter than in BFN 244 shown in FIG. 2. This reduction in line lengths 518 and 520, as well as other line lengths within BFN 402, reduces the power required by pre-amplifiers 516 to drive input signals 200–214 through BFN 402. This reduction in power increases the efficiency of the BFN 402, and thus increases the efficiency of the satellite. This increase in efficiency allows the satellite design to either be smaller overall, which reduces the weight of the satellite, or allows for more power to be diverted to the amplifiers 236, which provides a higher EIRP for the coverage regions of the antenna array 100.

As compared to BFN 244, BFN 402 reduces the power requirements from 336 watts for BFN 244 to 34 watts for BFN 402. This ten-fold reduction, along with the interconnections of the primary dividing network 404 and secondary dividing networks 406–418, allow the present invention to also reduce the gain requirements of amplifiers 236 from 44 dB to 36 dB for the central subarray 312 and from 35 dB to 31 dB for the outer six subarrays 300–310. This reduction allows for the satellite to use more efficient SSPAs for amplifiers 236.

Table 1 compares the insertion loss and power dissipation for two versions of BFN 244, one with an intermediate power amplifier (IPA) placed immediately after the divider network 216, and one without IPAs, with the BFN 402 of the present invention. Although the insertion losses are comparable when coaxial lines are used throughout for all three designs, the power dissipation and number of devices vary drastically. The BFN 244 without IPAs suffers from the need for a large driver amplifier (DA) before the 1:547 divider network and high SSPA gain. The high output power required for the driver amplifiers would most likely be realized with Traveling Wave Tube Amplifiers (TWTAs). The high gain SSPAs (40–44 dB gain) required in the BFN 244 with or without the IPAs challenge the state-of-the-art. The BFN 244 using IPAs doubles the number of power amplifiers required, which results in much higher power dissipation (1110 watts).

The BFN 402 of the present invention features low power dissipation (34 watts), modest SSPA gain (31–36 dB), reasonable IPA and DA gains and power levels, and requires the minimum number of devices thereby easing integration and test. The insertion loss of BFN 402 of the present invention can further be reduced by using low loss waveguide for the primary dividing networks 404 employed by modules 500–514, which would negligibly affect the weight of the satellite since the primary dividing network 402 is small.

Divider Network Diagrams

Figure 6A:
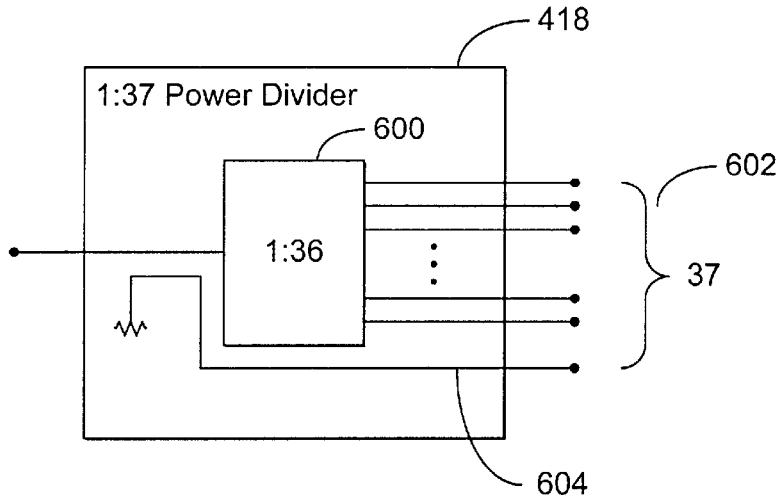
FIGS. 6A–6B are block diagrams for the secondary dividing networks of the present invention.
Figure 6B:
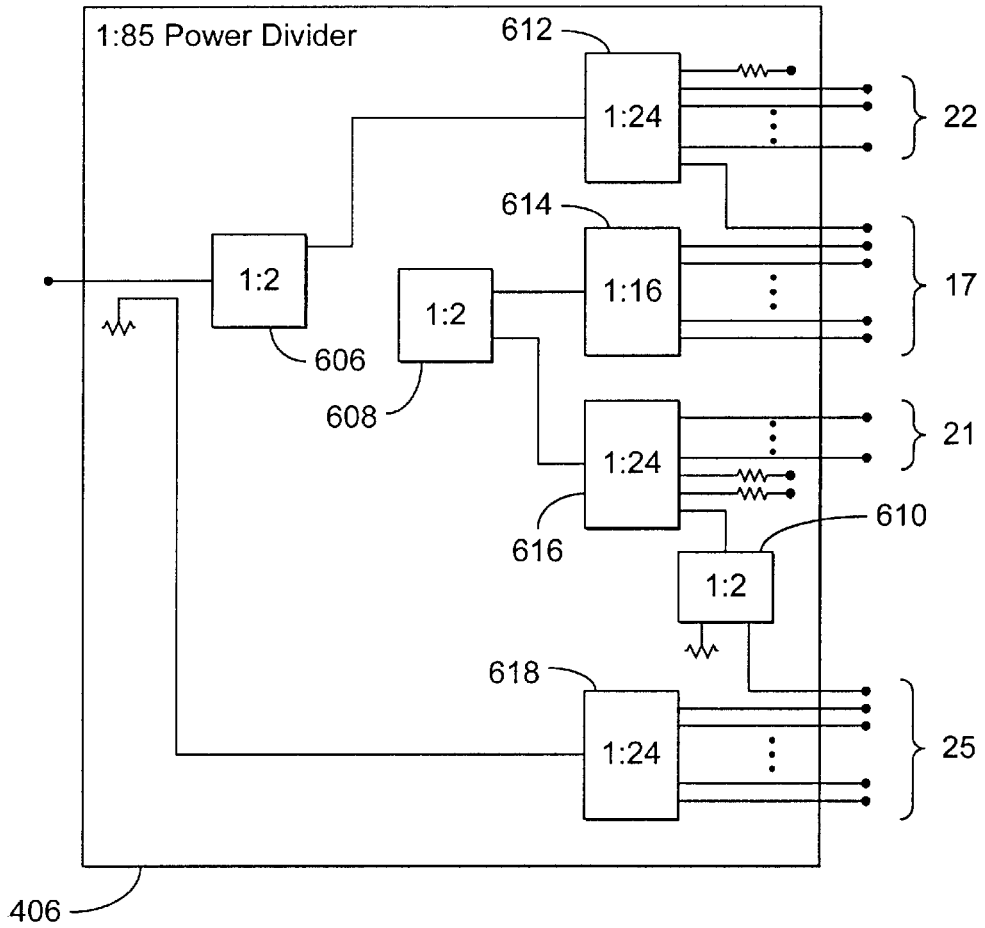

FIGS. 6A–6B are block diagrams for the secondary dividing networks of the present invention.

FIG. 6A illustrates one embodiment that can be used to implement secondary dividing network 418. A standard 1:36 divider network 600 is used to create 36 of the output signals 602, whereas the $37^{th}$ output signal 602 is created by a compensated stripline 604. Other embodiments are possible to create the required outputs for secondary dividing network 418 without departing from the scope of the present invention.

FIG. 6B illustrates one embodiment that can be used to implement secondary dividing networks 406–416. Secondary dividing network 406 is illustrated, but any of the secondary dividing networks 406–416 can take the form shown in FIG. 6B.

Standard dividing networks 606–618 can be used to implement the 1:85 secondary unequal power dividing network 406. The use of standard dividing networks 600 and 606–618 reduces the cost of manufacturing BFN 402, as well as making the integration and test of BFN 402 less time consuming. Other embodiments are possible to create the required outputs for secondary dividing networks 406–416 without departing from the scope of the present invention.

Reconfigurable Beams

The ability to reconfigure any arbitrary number of beams or all of the beams by the antenna array 100 on-orbit is achieved through the variable phase shifter 232. These beams can be reconfigured to different geographical locations and/or to different shapes as desired. The phase-only synthesis of the coverage beams allows the beamforming network 402 to be independent of the beam reconfigurability and allows maximization of the SSPA 236 efficiency.

The present invention is also applicable to receive antenna arrays 100, where the beamforming network 402 is placed behind the low-noise amplifiers (LNAs).

Process Chart

Figure 7:
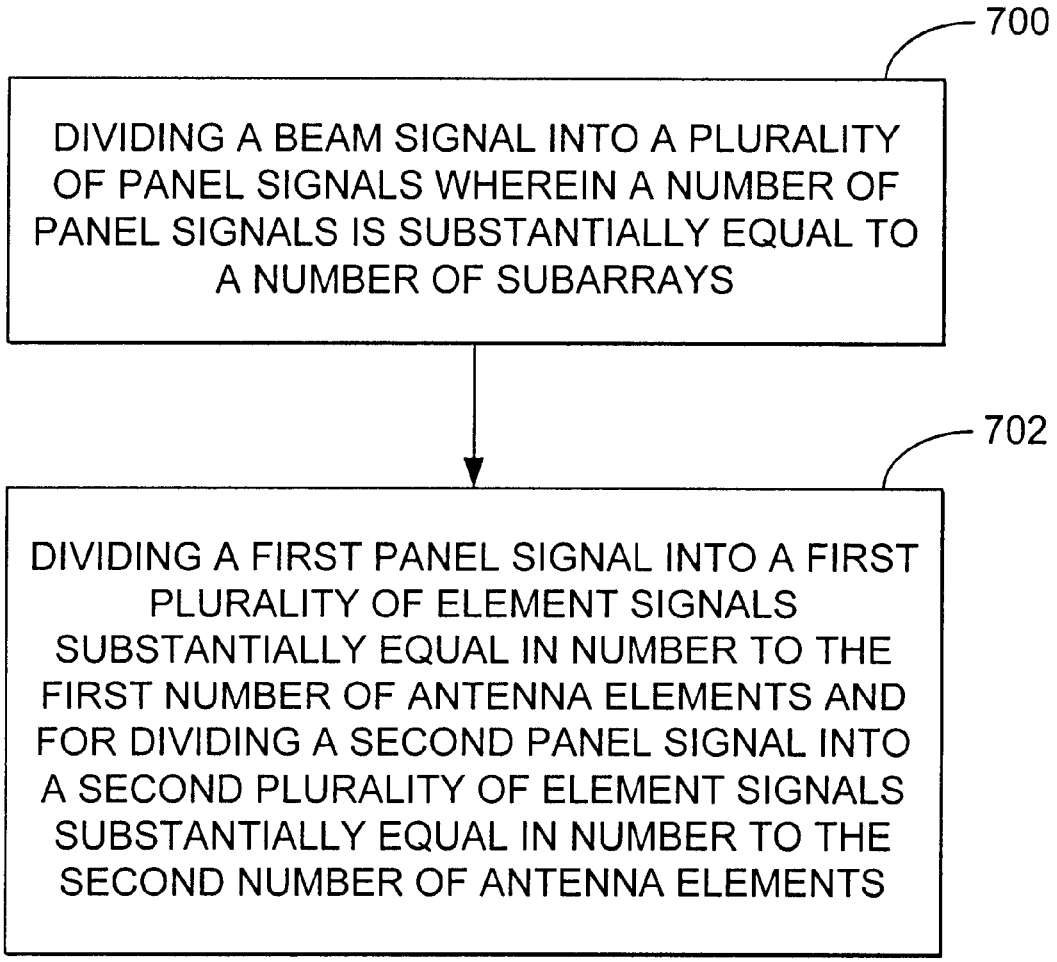
FIG. 7 is a flow chart illustrating the steps used in practicing the present invention.

FIG. 7 is a flowchart illustrating the steps used to practice the present invention.

Block 700 illustrates the present invention performing the step of dividing a beam signal into a plurality of panel signals, wherein a number of panel signals is substantially equal to a number of subarrays.

Block 702 illustrates the present invention performing the step of dividing a first panel signal into a first plurality of element signals substantially equal in number to the first number of elements and for dividing a second panel signal into a second plurality of element signals substantially equal in number to the second number of elements.

Conclusion

This concludes the description of the preferred embodiment of the invention. The following paragraphs describe some alternative methods of accomplishing the same objects and some additional advantages for the present invention.

Although discussed with respect to horns 102, other antenna elements can be used to implement the antenna array 100 of the present invention. The system of the present invention can be applied to satellites in geosynchronous, Low Earth Orbit, Middle Earth Orbit, or other orbital dynamic scenarios without departing from the scope of the present invention.

The techniques described in the present invention can be used to make smaller low-power satellites economically feasible, as well as the ability to more completely utilize present satellite configurations.

In summary, the present invention provides a method and apparatus for forming satellite transmission beams. A beamforming network in accordance with the present invention comprises an array of antennas and primary and secondary dividing networks. The array of antennas comprises at least a first subarray having a first number of elements and a second subarray having a second number of elements. The primary dividing network divides a beam signal into a plurality of panel signals, wherein a number of panel signals is substantially equal to a number of subarrays. The secondary dividing network divides a first panel signal into a first plurality of element signals substantially equal in number to the first number of elements and for dividing a second panel signal into a second plurality of element signals substantially equal in number to the second number of elements.

The foregoing description of the preferred embodiment of the invention has been presented for the purposes of illustration and description and is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A beamforming network, comprising:

an array of antennas, comprising at least a first subarray having a first number of elements and a second subarray having a second number of elements;

a primary dividing network for dividing a beam signal into a plurality of panel signals, wherein a number of panel signals is substantially equal to a number of subarrays; and a secondary dividing network, coupled to the primary dividing network, for dividing a first panel signal into a first plurality of element signals substantially equal in number to the first number of elements and for dividing a second panel signal into a second plurality of element signals substantially equal in number to the second number of elements;

wherein the element signals are amplified.

2. The beamforming network of claim 1, wherein the first number of elements and the second number of elements are equal.

3. The beamforming network of claim 1, wherein the primary dividing network includes redundant paths through the primary dividing network.

4. The beamforming network of claim 1, wherein the primary dividing network receives multiple beam signals.

5. The beamforming network of claim 1, wherein the secondary dividing network comprises modules.

6. The beamforming network of claim 1, further comprising a transmitter for transmitting the element signals.

7. A method for forming a first beam and a second beam from an array of antennas, wherein the array of antennas comprises a first subarray having a first number of antenna elements and a second subarray having a second number of antenna elements, comprising the steps of:

dividing a beam signal into a plurality of panel signals, wherein a number of panel signals is substantially equal to a number of subarrays;

dividing a first panel signal into a first plurality of element signals substantially equal in number to the first number of antenna elements and for dividing a second panel signal into a second plurality of element signals substantially equal in number to the second number of antenna elements; and amplifying the element signals.

8. The method of claim 7, wherein the first number of antenna elements and the second number of antenna elements are substantially equal.

9. The method of claim 7, wherein the step of dividing the input signals comprises the step of providing redundant paths through a primary dividing network.

10. A beamforming network for forming a desired number of beams to be transmitted by a satellite, comprising:

a primary dividing network for dividing a beam signal into a plurality of panel signals, wherein a number of panel signals is substantially equal to the desired number of beams; and a secondary dividing network, coupled to the primary dividing network, for dividing the plurality of panel signals into groups of element signals, wherein each group of element signals is used to form one of the desired beams;

wherein the element signals are amplified.

11. The beamforming network of claim 10, wherein a number of divided signals in each group of divided are substantially equal.

12. The beamforming network of claim 10, where the primary dividing network includes redundant paths through the primary dividing network.

13. The beamforming network of claim 10, wherein the primary dividing network receives multiple beam signals.

14. The beamforming network of claim 10, wherein the secondary dividing network comprises modules.

15. A signal, to be transmitted by an array of antennas, wherein the array of antennas comprises at least a first subarray having a first number of elements and a second subarray having a second number of elements formed by performing the steps of:

dividing a beam signal into a plurality of panel signals, wherein a number of panel signals is substantially equal to a number of subarrays;

dividing a first panel signal into a first plurality of element signals substantially equal in number to the first number of elements and for dividing a second panel signal into a second plurality of element signals substantially equal in number to the second number of elements;

amplifying the element signals; and transmitting the first plurality of element signals from the first subarray and the second plurality of element signals from the second subarray for forming the signal.

* * * * *